US007900899B2

(12) United States Patent
Kawaguchi

(10) Patent No.: US 7,900,899 B2
(45) Date of Patent: Mar. 8, 2011

(54) CREASING DEVICE IN ACCORDANCE WITH SHEET KIND

(75) Inventor: Takahiro Kawaguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 296 days.

(21) Appl. No.: 12/180,799

(22) Filed: Jul. 28, 2008

(65) Prior Publication Data

US 2009/0033017 A1 Feb. 5, 2009

Related U.S. Application Data

(60) Provisional application No. 60/952,844, filed on Jul. 30, 2007.

(30) Foreign Application Priority Data

Mar. 14, 2008 (JP) ..... P2008-065672

(51) Int. Cl.
*B65H 37/04* (2006.01)

(52) U.S. Cl. ..... 270/37; 270/45; 493/445

(58) Field of Classification Search ..... 270/37, 270/45; 493/444, 445
See application file for complete search history.

(56) References Cited

U.S. PATENT DOCUMENTS

| | | | | |
|---|---|---|---|---|
| 4,592,651 | A * | 6/1986 | Oikawa et al. | 355/72 |
| 6,929,256 | B2 * | 8/2005 | Kawatsu et al. | 270/37 |
| 7,293,766 | B2 * | 11/2007 | Ruthenberg et al. | 270/37 |
| 7,523,593 | B2 * | 4/2009 | Aoyagi et al. | 53/117 |
| 7,681,872 | B2 * | 3/2010 | Hayashi | 270/37 |
| 7,753,353 | B2 * | 7/2010 | McNamara | 270/37 |
| 2004/0126163 | A1 | 7/2004 | Asami et al. | |

FOREIGN PATENT DOCUMENTS

| | | |
|---|---|---|
| JP | 2000-153958 | 6/2000 |
| JP | 2004-244128 | 9/2004 |

* cited by examiner

*Primary Examiner* — Patrick Mackey
(74) *Attorney, Agent, or Firm* — Patterson & Sheridan, LLP

(57) ABSTRACT

A sheet post-processing apparatus includes a taking-in portion configured to support sheets conveyed with their leading edges in a conveying direction directed downward in a standing position and release the support of the sheets, a folding portion configured to crease the sheets, which are supported by the taking-in portion, by pressing and release the creased sheets into the taking-in portion, a loading portion arranged under the taking-in portion to load the creased sheets conveyed from the taking-in portion, a stitching portion configured to stitch a sheet bundle loaded on the loading portion, and a controller configured to execute conveying of the sheets to the taking-in portion and creasing of the sheets supported on the taking-in portion by the folding portion during stitching the creased sheet bundle loaded on the loading portion by the stitching portion.

17 Claims, 11 Drawing Sheets

CREASING DEVICE IN ACCORDANCE WITH SHEET KIND

CROSS-REFERENCE TO RELATED APPLICATION

This application is based upon and claims the benefit of priority from the prior U.S. Patent Application No. 60/952,844, filed on Jul. 30, 2007; the entire contents of all of which are incorporated herein by reference.

This application is based upon and claims the benefit of priority from the prior Japanese Patent Application No. 2008-65672, filed on Mar. 14, 2008, the entire contents of all of which are incorporated herein by reference.

FIELD OF THE INVENTION

The present invention relates to a sheet post-processing apparatus to perform a post process for sheets.

DESCRIPTION OF THE BACKGROUND

Japanese Patent Application Publication No. 2000-153958 discloses a sheet post-processing apparatus for performing stitching and folding processes.

In the sheet post-processing apparatus, a sheet positioning member movable up and down for receiving the leading edge of each sheet in the conveying direction, a stapler unit for stitching a sheet bundle stored in the sheet positioning member, a folding roller pair for folding the stitched sheet bundle, and a folding drive mechanism having a projection unit are arranged sequentially downward from above. When sheet bundles for each document are all loaded by the sheet positioning member, they are stitched by the stapler unit. Thereafter, the sheet positioning member is moved, thus the sheet bundles are moved to the position of the folding drive mechanism, and the folding roller pair and projection unit perform the folding process. The folding drive mechanism pushes the sheet bundle pushed by the projection unit into the nip portion of the folding roller pair from one side, holds under pressure and discharges it from the opposite side, and then book-binds and loads it on the receiving tray.

However, the apparatus aforementioned performs the stitching process for the sheet bundle and then performs the folding process, so that the sheet positioning member must move from the position where the sheet bundle is subjected to the stitching process to the position where the folding process is performed. Further, when processing a plurality of sheet bundles, the sheet positioning member must return from the position where the folding process for the sheet bundle performs to the position where the stitching process performs again. Therefore, the processing of the sheet bundles takes a lot of time.

Further, in the apparatus aforementioned, the sheet positioning member supports the sheet bundle while processing one sheet bundle. Therefore, until the bookbinding process of the sheet bundle is completed, the succeeding sheets cannot be conveyed, thus when processing a plurality of sheet bundles, a problem arises that the throughput until completion of all the jobs is not good.

Further, in the apparatus aforementioned, the stitching process is performed for sheets in correspondence to the number of job copies and then the folding-in-two process is performed, so that when heavy paper is used, the number of sheets cannot be increased. Further, if glossy paper is used, when holding under pressure and conveying them by the folding roller pair, between the overlaid sheets, slipping occurs and a problem arises that the outside sheet in contact with the rollers slips and is conveyed prior.

Further, in the apparatus aforementioned, the sheet conveying path during loading, stitching, and folding the sheets is arranged almost perpendicularly, so that a problem arises that the apparatus is enlarged in the longitudinal direction. Furthermore, to perform the folding process for a heavy paper bundle, a strong structure is necessary and a problem arises that the apparatus is enlarged.

SUMMARY OF THE INVENTION

In an embodiment of the present invention, there is provided a sheet post-processing apparatus comprising a taking-in portion configured to support sheets conveyed with their leading edges in a conveying direction directed downward in a standing position and release the support of the sheets; a folding portion configured to crease the sheets, which are supported by the taking-in portion, by pressing and release the creased sheets into the taking-in portion; a loading portion arranged under the taking-in portion to load the creased sheets conveyed from the taking-in portion; a stitching portion configured to stitch a sheet bundle loaded on the loading portion; and a controller configured to execute conveying of the sheets to the taking-in portion and creasing of the sheets supported on the taking-in portion by the folding portion during stitching the creased sheet bundle loaded on the loading portion by the stitching portion.

Furthermore, in an embodiment of the present invention, there is provided a sheet post-processing method comprising supporting sheets conveyed with their leading edges in a conveying direction directed downward in a standing position by a taking-in portion; creasing the sheets supported in the standing position by the taking-in portion by a folding portion and then releasing again the sheets into the taking-in portion; conveying the creased sheets in the taking-in portion to a loading portion arranged under the taking-in portion; loading the creased sheets conveyed on the loading portion; stitching a creased sheet bundle loaded on the loading portion by a stitching portion; and executing conveyance of the sheets to the taking-in portion and creasing of the sheets supported by the taking-in portion by the folding portion during stitching the sheet bundle by the stitching portion.

DETAILED DESCRIPTION OF THE INVENTION

Hereinafter, the embodiments will be explained with reference to the accompanying drawings.

Figure 1:
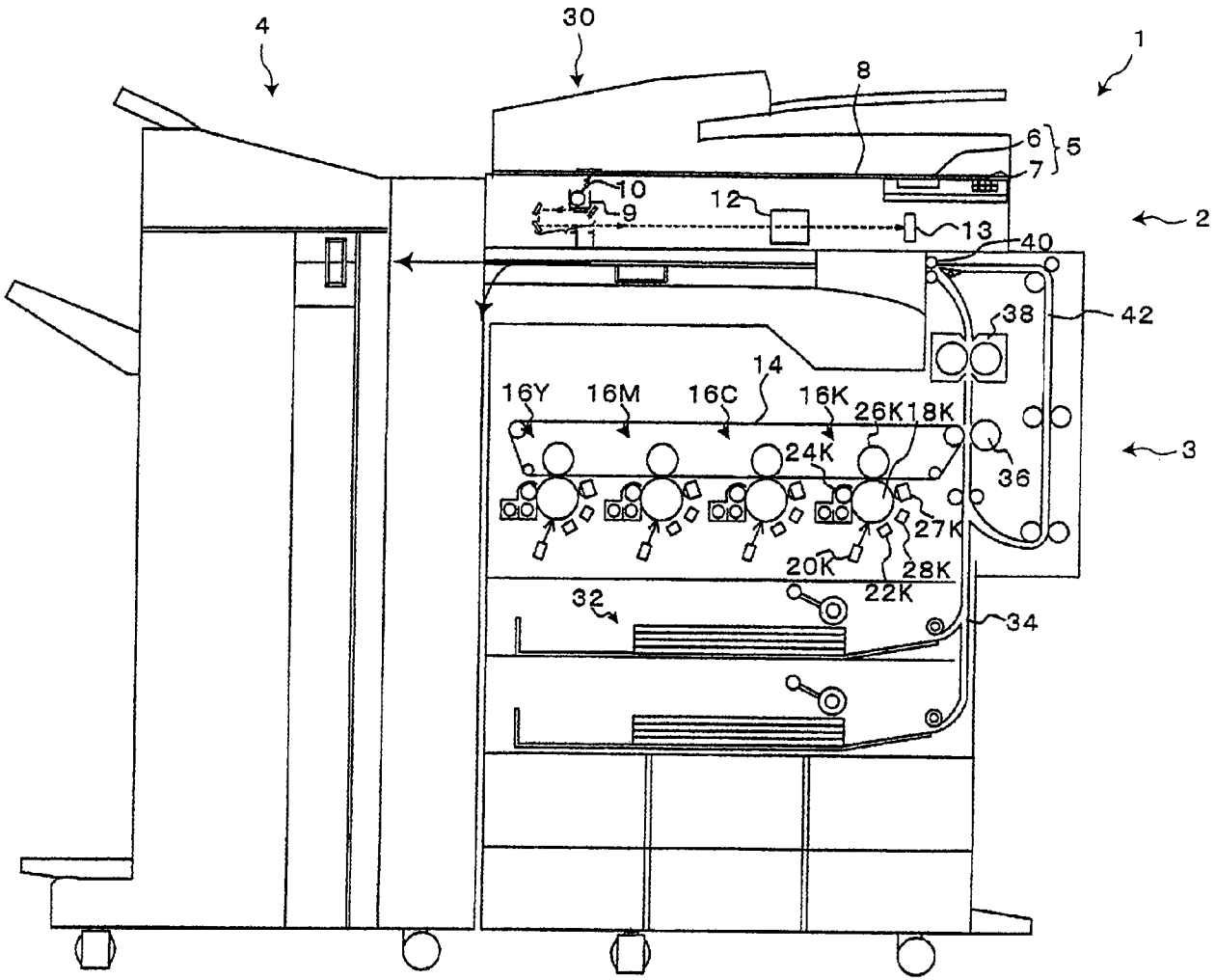
FIG. 1 is a schematic block diagram of the image forming apparatus of the first embodiment.

(First embodiment) FIG. 1 is a schematic block diagram of the image forming apparatus.

An image forming apparatus 1 includes an image reading portion 2 for reading an image to be read and an image forming portion 3 for forming an image. There is an operation panel 5 including a display 6 of a touch panel type and various kinds of operation keys 7 in the upper part of the image forming apparatus 1.

The operation keys 7 of the operation panel 5, for example, include ten keys, a reset key, a stop key, and a start key. The display 6 is used to set the sheet size, number of sheets, and print concentration and input various processes such as the stitching process.

The image reading portion 2 includes a light-transmissible original table 8, a carriage 9, an exposure lamp 10, a reflection mirror 11, an imaging lens 12 for converging reflected light, and a CCD (charge coupled device) 13 for fetching the reflected light and converting image information by light to an analog signal.

The image forming portion 3 includes an intermediate transferring belt 14 as a transfer medium and four processing units 16Y, 16M, 16C, and 16K corresponding to toner of the respective colors of yellow (Y), magenta (M), cyan (C), and black (K) which are arranged side by side along the intermediate transferring belt 14.

The processing unit 16K includes a photoconductor 18K as an image carrier, a laser unit 20K for forming an electrostatic latent image on the photoconductor 18K, a charger 22K and a developing device 24K which are arranged sequentially around the photoconductor 18K, and a primary transferring device 26K, a cleaner 27K, and a charge elimination lamp 28K which are opposite to a photosensitive drum 8K across the intermediate transferring belt 14. The processing units 16Y, 16M, and 16C have the same constitution as that of the processing unit 16K. Hereinafter, the constitution will be explained by referring to the processing unit 16K of black (K).

To a document put on the original table 8 or a document sent by an automatic document feeder 30, by an exposure means including the carriage 9 and the exposure lamp 10 supported on the carriage 9, light is irradiated from the underneath of the original table 8. Then, the reflected light from the document is induced by the reflection mirror 11 and is focused by the imaging lens 12, thus the reflected light is projected to the CCD 13. The image information fetched by the CD 13 is output as an analog signal, then is converted to a digital signal, is subject to the image process, and then is transmitted to the laser unit 20K.

When the image formation is started in the image forming portion 3, the charger 22K gives a charge to the outer peripheral surface of the photoconductor 18K rotating. To the outer peripheral surface of the photoconductor 18K which is charged at a uniform potential in the axial direction by the charger 22K, according to the image information transmitted from the CCD 13, a laser beam is irradiated from the laser unit 20K. When an electrostatic latent image corresponding to the image information of the document is formed on the outer peripheral surface of the photoconductor 18K by the irradiation of the laser beam, a developer of black (for example, toner) is fed to the outer peripheral surface of the photoconductor 18K by the developing device 24K and the electrostatic latent image is converted to a black toner image.

The developing device 24K has a developing roller which rotates and the developing roller is arranged and rotated opposite to the photoconductor 18K, thus toner is fed to the photoconductor 18K. When a toner image is formed on the outer peripheral surface of the photoconductor 18K, the black toner image is transferred electrostatically to the intermediate transferring belt 14 by the primary transferring device 26K. Further, the toner remaining on the photoconductor 18K without transferred is removed by the cleaner 27K positioned on the downstream side of the photoconductor 18K in the rotational direction rather than the primary transferring device 26K. Furthermore, the residual electric charge on the outer peripheral surface of the photoconductor 18K is removed by the charge elimination lamp 28K. When forming a color image, the aforementioned operation is performed similarly for the processing units 16Y, 16M, and 16C.

The toner image transferred to the intermediate transferring belt 14 is transferred electrostatically onto a sheet conveyed by a sheet feeder 32 via a conveying path 34 by a secondary transferring device 36. The sheet onto which the toner image is transferred is conveyed to a fixing device 38 and the toner image transferred onto the sheet is fixed onto the sheet by the fixing device 38. The toner image is fixed, thus the sheet on which the image formation is completed is conveyed toward a conveying roller 40.

When performing double side print, the conveying roller 40 is rotated reversely and conveys the sheet to a conveying path 42. The sheet sent to the conveying path 42 is conveyed again to the secondary transferring device 36 and fixing device 38 and an image is formed on the opposite-side surface of the sheet.

The sheet that the toner image is fixed, thus the image formation is completed is discharged from the image forming apparatus 1 by the conveying roller 40 and is sent to the sheet post-processing apparatus 4. The sheet is referred to as, for example, plain paper, a paper board, thin paper, glossy paper, or an OHP sheet.

Figure 2:
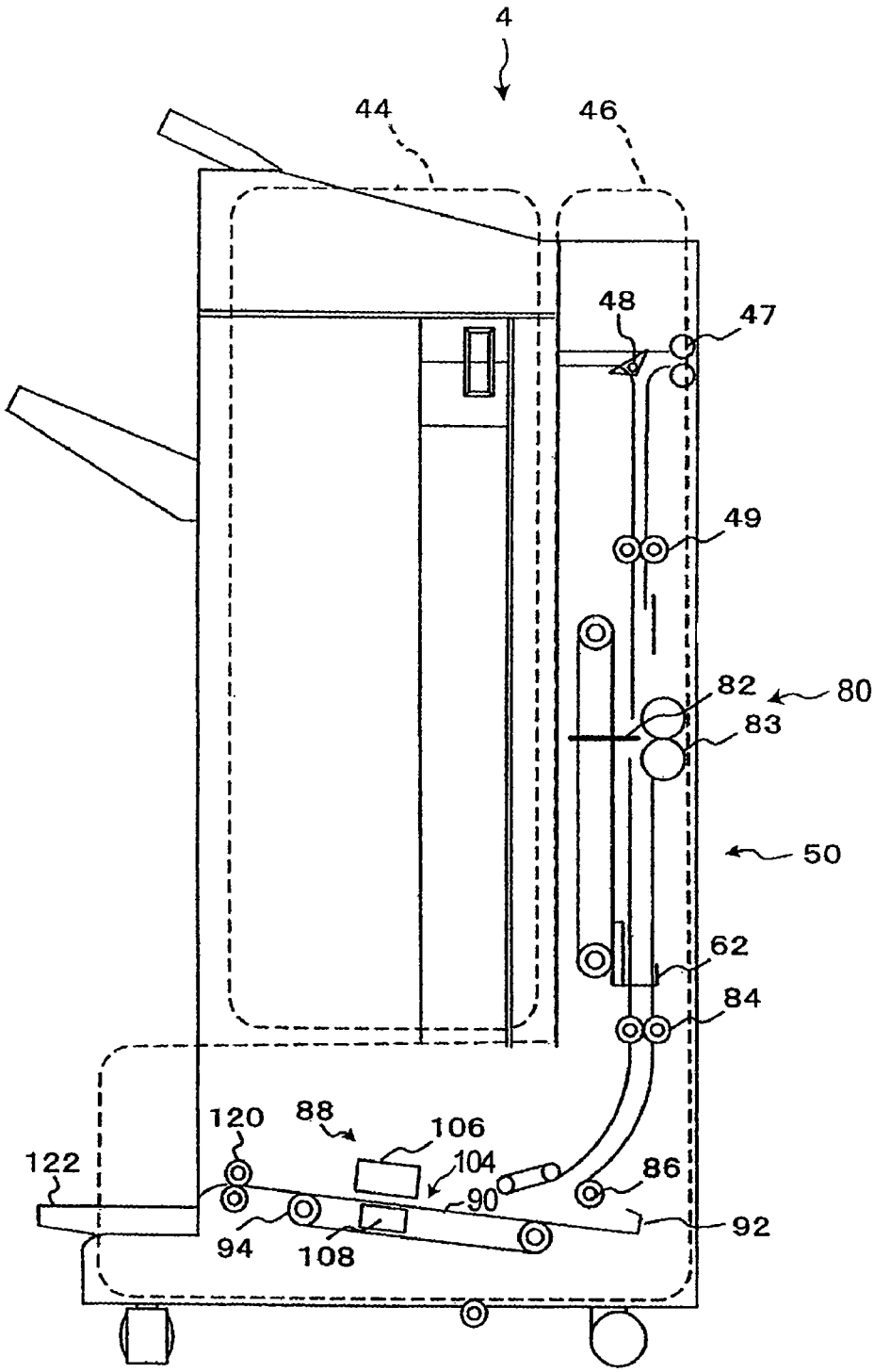
FIG. 2 is a schematic block diagram of the image post-processing apparatus of the first embodiment.

Next, the sheet post-processing apparatus 4 will be explained. FIG. 2 is a schematic view of the sheet post-processing apparatus.

The sheet post-processing apparatus 4 post-processes sheets discharged from the image forming apparatus 1 according to an input instruction from the operation panel 5 or a processing instruction from a personal computer. The sheet post-processing apparatus 4 includes an end stitch portion 44 for performing the post process other than the folding process and saddle stitching process, for example, the ordinary sorting process or sheet bundle end stitching process and a folding portion (a sheet folding apparatus) 46 for performing the folding process and saddle stitching process. Further, for the end stitch portion 44, the post-processing apparatus described in Japanese Patent Application Publication No. 2007-86862 and well-known arts can be used.

The folding portion 46 includes a taking-in portion 50 for receiving the leading edges of sheets conveyed downward from above in the conveying direction and temporarily loading the sheets until the folding process is performed, a folding portion 80 for performing the folding process for the sheets loaded on the taking-in portion 50, an alignment portion 88 for storing and aligning the sheets folded and conveyed, a saddle stitch member 104 for performing the saddle stitching process for the aligned sheet bundle, and a sheet bundle receiving tray 122 for receiving the sheet bundle stitched.

When performing the folding process and saddle stitching process, entrance rollers 47 carry the sheets discharged from the image forming apparatus 1 into the sheet post-processing apparatus 4. When the sheets are carried into the sheet post-processing apparatus 4, a branching member 48 deflects the conveying direction of the sheets and first conveying rollers 49 convey the sheets to the taking-in portion 50. In the taking-in portion 50, a stack portion 62 receives the leading edges of the sheets in the conveying direction. The stack portion 62 can move vertically so that the portion of each sheet to be folded comes to the folding position by the folding portion 80. In this embodiment, the portion of each sheet to be folded will be explained as the central part of each sheet.

When the stack portion 62 receives the leading edges of the sheets in the conveying direction, the folding portion 80 starts the folding process. Hereinafter, in the taking-in portion 50, the leading edge of each sheet in the conveying direction is defined as a lower end of the sheet and inversely, the rear end of each sheet in the conveying direction is defined as an upper end.

The folding portion 80 includes a metallic thin folding plate 82 and a folding roller pair 83. The folding plate 82 is generally shifted in order to avoid obstruction of conveyance of sheets and when folding the sheets, moves and pushes the sheets and presses out them toward the nip portion of the folding roller pair 83. When the folding plate 82 of the folding portion 80 pushes the sheets into the nip portion of the folding roller pair 83, the folding roller pair 83 holds the sheets under pressure in the nip portion and creases the sheets. Here, the sheets are in the state that they are not folded in two.

Then, second conveying rollers 84 convey creased sheets toward a third conveying roller 86 and the third conveying roller 86 carries out the sheets to the alignment portion 88.

The alignment portion 88 includes a loading member 90 arranged on the bottom of the sheet post-processing apparatus 4 for loading carried-out sheets on each side and a positioning member 92 for moving by a conveying device 94.

When sheets in correspondence to the number of job copies are stored in the loading member 90 of the alignment portion 88, the positioning member 92 moves so that the fold position comes to the stitching position by the saddle stitch member 104 and a saddle stitching stapler 106 of the saddle stitch member 104 and an anvil 108 perform the stitching process for the sheet bundle. The sheet carried out to the alignment portion 88 is given a fold, so that the alignment of the sheet crossing the fold of the succeeding sheet in the length direction, that is, the alignment of the sheets in the conveying direction can be executed easily.

When the stitching process is performed for the sheet bundle, the conveying device 94 furthermore drives the positioning member 92 and conveys the sheet bundle toward exit rollers 120, thus the exit rollers 120 discharge the sheet bundle to the sheet bundle receiving tray 122.

Figure 3:
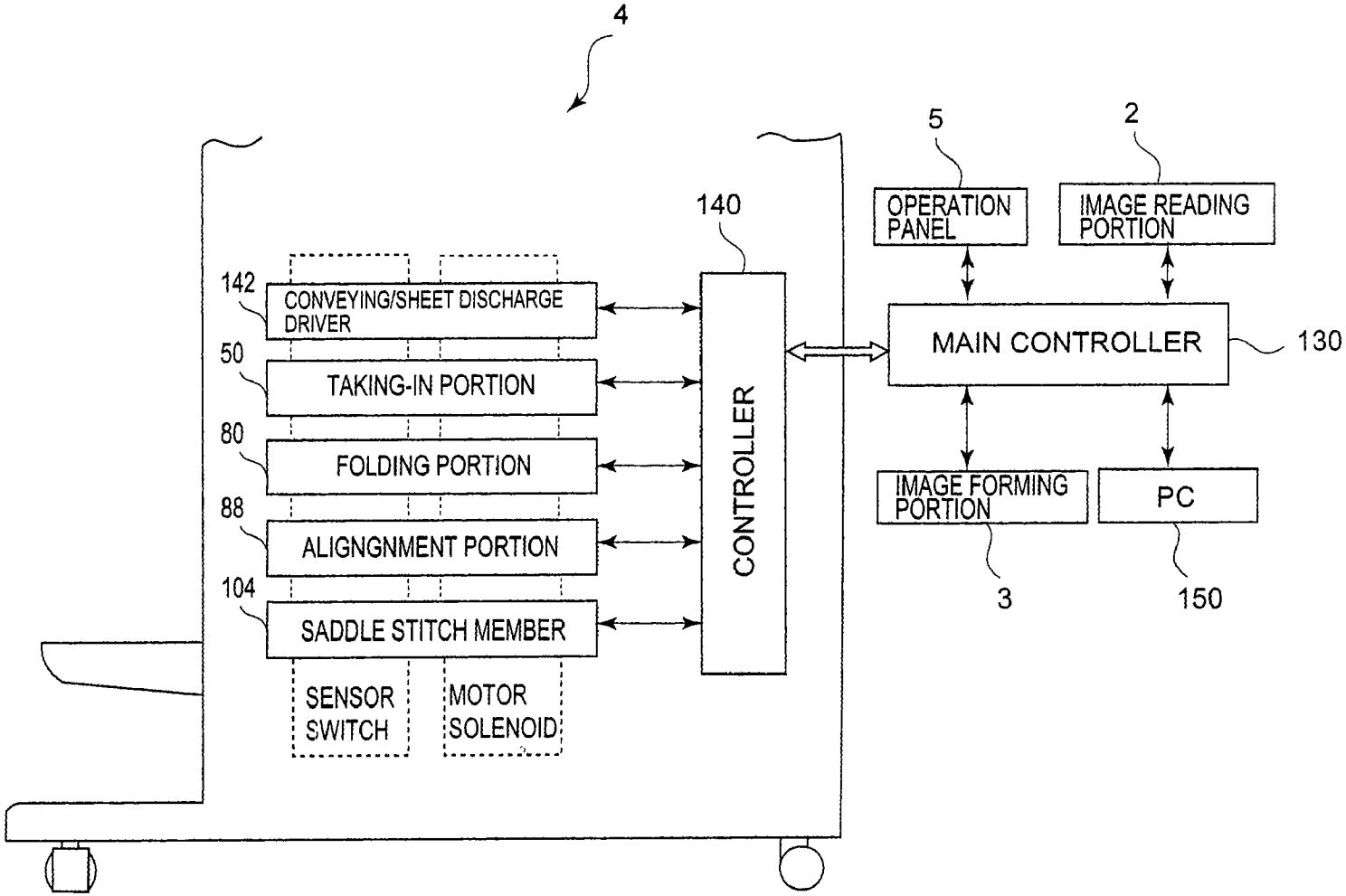
FIG. 3 is a schematic block diagram of the control system of the image forming apparatus and sheet post-processing apparatus.

FIG. 3 is a schematic block diagram of the control system of the image forming apparatus and sheet post-processing apparatus.

The image forming apparatus 1 has a main controller 130 for controlling the whole image forming apparatus 1. The main controller 130 controls synthetically the image reading portion 2, image forming portion 3, operation panel 5, and controller 140 of the sheet post-processing apparatus 4. The main controller 130 furthermore performs the image process such as correction, compression, or expansion of image data, stores the compressed image data or print data, and executes data communication with a PC (personal computer) 150 installed outside the image forming apparatus 1.

The controller 140 of the sheet post-processing apparatus 4, on the basis of an instruction from the main controller 130, controls various operations of the folding portion 46, that is, the operation of each unit of the entrance rollers 47, branching member 48, a conveying/sheet discharge driver 142 of the first conveying rollers 49, taking-in portion 50, folding portion 80, alignment portion 88, and saddle stitch member 104.

Figure 4B:
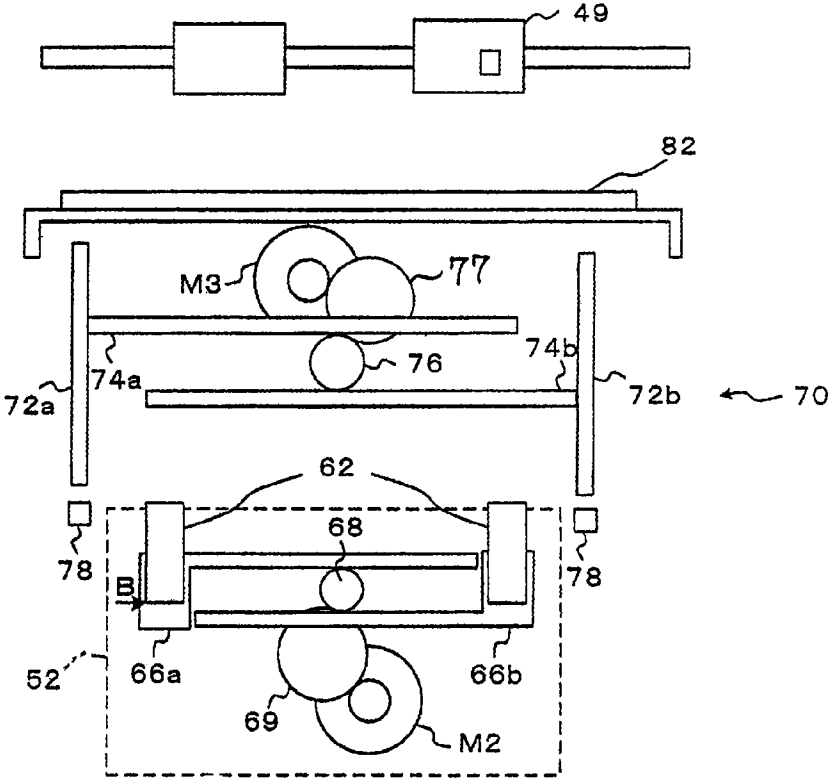
FIG. 4B is a schematic view for explaining the mechanism around the taking-in portion viewed in the direction of the arrow A shown in FIG. 4A.
Figure 4A:
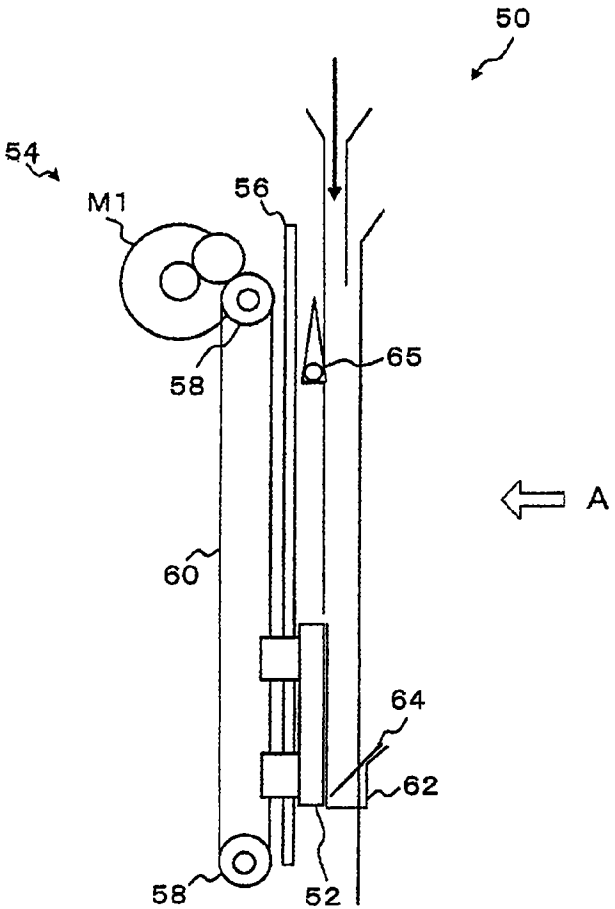
FIG. 4A is a schematic side view for explaining the taking-in portion of the first embodiment.

FIGS. 4A and 4B are schematic diagrams for explaining the taking-in portion 50, and FIG. 4A is a schematic side view of the taking-in portion 50, and FIG. 4B is a schematic diagram for explaining the mechanism around the taking-in portion 50 viewed in the direction of the arrow A shown in FIG. 4A.

The taking-in portion 50 includes a stack unit 52 and a driving portion 54 for driving up and down the stack unit 52. The driving portion 54 includes a support bar 56 for supporting the stack unit 52 in the movement direction, a belt 60 wound and suspended by a pulley 58, and a motor M1. Power is transmitted from the motor M1, thus the belt 60 is moved, and the stack unit 52 attached to the belt 60 moves up and down in the conveying direction of sheets.

To the stack unit 52, the stack portion 62 for receiving the leading edge of each sheet in the conveying direction, that is, the lower end is attached. The stack portion 62 has a sheet leading edge sensor 64 for detecting arrival of the lower end of each sheet, for example, a micro-sensor or a micro-actuator. A taking-in aid member 65 is used when loading a plurality of sheets on the stack portion 62 and will be described later in detail.

As shown in FIG. 4B, the stack unit 52 includes bridging members 66*a* and 66*b* which are parallel with each other, are partially opposite to each other, and slide the stack portion 62 in the width direction (hereinafter, referred to as the sheet width direction) crossing the sheet conveying direction, a pinion gear 68, and a motor M2.

The bridging members 66*a* and 66*b* have a rack respectively on the opposite surfaces and between the bridging members 66*a* and 66*b*, the pinion gear 68 simultaneously fitted into the respective racks is arranged. The power of the motor M2 is transmitted to the pinion gear 68 via a gear 69. When the pinion gear 68 is rotated, the bridging members 66*a* and 66*b* slide in the width direction of the sheet in the opposite directions. Further, the arrow B shown in the drawing indicates the position where the stack portion 62 receives the lower end of the sheet.

The taking-in portion 50 has a lateral alignment unit 70. The lateral alignment unit 70 has lateral alignment members 72*a* and 72*b* for aligning sheets loaded on the stack portion 62 in the width direction. The lateral alignment members 72*a* and 72*b* are in the position which counters mutually. Bridging members 74*a* and 74*b* are parallel respectively toward the lateral alignment members 72*a* and 72*b*, and a part counters. The lateral alignment unit 70 has a pinion gear 76 and a motor 3.

The bridging members 74*a* and 74*b* have a rack respectively on the opposite surfaces and between the bridging members 74*a* and 74*b*, the pinion gear 76 simultaneously fitted into the respective racks is arranged. The power of the motor M3 is transmitted to the pinion gear 76 via a gear 77 and when the pinion gear 76 is rotated, the bridging members 74*a* and 74*b* slide in the width direction of the sheet in the opposite directions. Further, the positions of the lateral alignment members 72*a* and 72*b* in the direction of the sheet width, for example, are detected by a position sensor 78 having a micro-sensor or a micro-actuator. In the taking-in portion 50, when the folding process is instructed from the operation panel 5 or the PC 150, if the stack portion 62 receives the lower ends of sheets and the lateral alignment unit 70 aligns the sheets in the width direction, the folding plate 82 and folding roller pair 83 of the folding portion 80 perform the folding process for the sheets. The loading operation of the taking-in portion 50 and the folding operation of the folding portion 80 will be described later.

Figure 5:
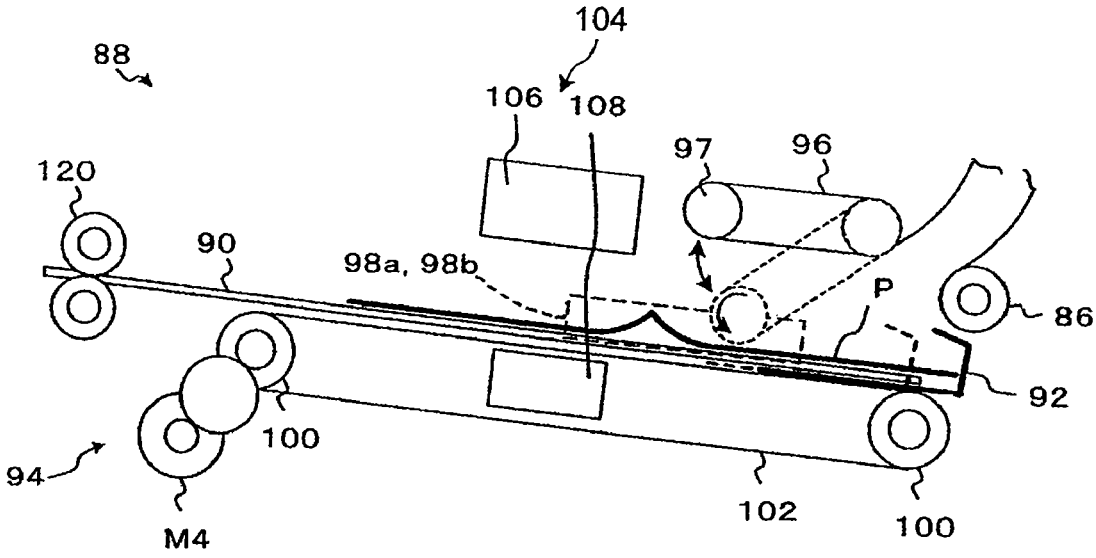
FIG. 5 is a schematic view for explaining the alignment portion of the first embodiment.

FIG. 5 is a schematic view for explaining the alignment portion.

The loading member 90 of the alignment portion 88 is arranged on the bottom of the sheet post-processing apparatus 4 with a slight slope to the horizontal direction and loads carried-out sheets on each side. The alignment portion 88 can rotate and has a loading aid member 96 arranged away from the surface of the loading member 90.

The loading aid member 96, when sheets are conveyed to the loading member 90, stands by at a position free of disturbance of conveyance. If the sheets are loaded on the loading member 90, the loading aid member 96, as shown by a dotted line in FIG. 5, rotates at a fulcrum of one end thereof and makes contact with the loaded sheets at the other end. The loading aid member 96 has, for example, a rotary roller 97 at the other end making contact with sheets and the roller 97 rotates, thereby presses one end of each loaded sheet against the positioning member 92. This operation is repeated for each conveyance of sheets and a sheet bundle is loaded on the loading member 90. Particularly, the alignment portion 88 turns sheets sideways and loads them on the loading member 90 on each side and moreover, since the sheets carried out to the alignment portion 88 are given a fold, the loading aid member 96 performs the aforementioned operation, thus the succeeding sheets, when carried out onto the loaded sheets, are overlapped easily on the basis of the fold. Due to this overlap, the alignment of sheets crossing the fold in the length direction, that is, the alignment of sheets in the conveying direction can be executed easily. The loading aid member 96 may move up and down to separate from and make contact with sheets. The loading aid member 96 may be a belt which runs to align the sheets.

Further, the alignment portion 88 has lateral alignment members 98*a* and 98*b* for aligning sheets in the width direction. For the lateral alignment members 98*a* and 98*b*, for example, ones similar to the lateral alignment members 72*a* and 72*b* may be used. Further, as lateral alignment timing, it is possible to execute the alignment for each conveyance of sheets or to execute the alignment at the stage that sheets in correspondence to the number of job copies are loaded.

The conveying device 94 includes a belt 102 wound and suspended by a pulley 100 and a motor M4. The power is transmitted from the motor M4, thus the belt 102 moves and the positioning member 92 attached to the belt 102 moves long the loading member 90.

When sheets in correspondence to the number of job copies are stored on the loading member 90 and are aligned laterally, the positioning member 92 moves the folding position of each sheet to the stitching position of the saddle stitch member 104 and stops.

Then, the saddle stitching stapler 106 of the saddle stitch member 104 and the anvil 108 perform the stitching process for the sheet bundle. When the stitching process is performed for the sheet bundle, the positioning member 92 moves furthermore toward the exit rollers 120 and conveys the sheet bundle and the sheet bundle is discharged onto the sheet bundle receiving tray 122 by the exit rollers 120.

Figure 6A:
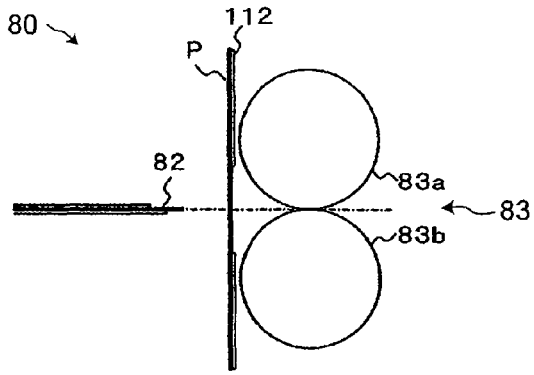
FIGS. 6A to 6D are schematic views for explaining the folding operation.
Figure 6B:
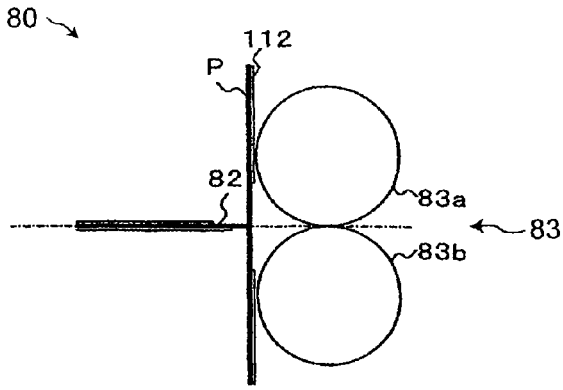
Figure 6C:
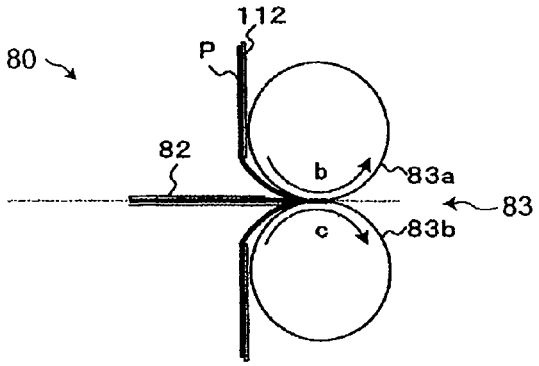
Figure 6D:
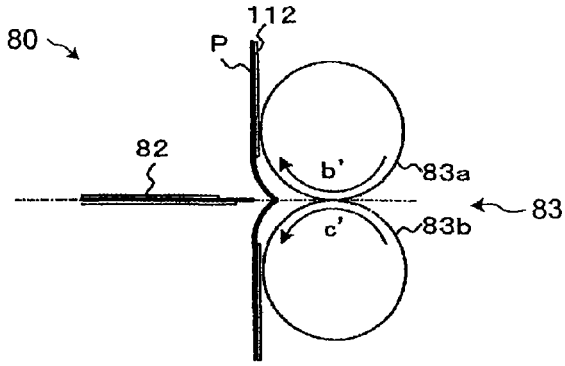

Next, by referring to FIGS. 6A to 6D, the folding operation of the folding portion 60 will be explained briefly. As shown in FIG. 6A, the folding plate 82, when the sheet P is conveyed, stands by at the position free of disturbance of conveyance of the sheet P (FIG. 6A). If the folding process is started, the folding plate 82 moves toward the folding roller pair 83 and the leading edge of the folding plate 82 pushes the sheet P (FIG. 6B). The folding plate 82 pushing the sheet P moves furthermore toward the folding roller pair 83 and leads the sheet P to the nip portion of the folding roller pair 83. The first roller 83*a* and second roller 83*b* of the folding roller pair 83 rotate respectively along the arrows b and c and hold the sheet P under pressure to give a fold (FIG. c). Then, the first roller 83*a* and second roller 83*b* of the folding roller pair 83, unless they fold straight the sheet in two, rotate respectively in the directions of the arrows b' and c' which are the opposite directions of the arrows b and c and release the sheet P from the nip portion. The sheet P creased by the aforementioned operation, if the holding of the lower end by the bridging members 66*a* and 66*b* is released, falls by its own weight or moves more downward by the second conveying rollers 84, and thereafter is conveyed to the alignment portion 88.

In an apparatus for folding sheets in two as conventional, for sheets in correspondence to the number of job copies, the stitching process is performed and then the folding process for folding sheets in two is performed. Therefore, when heavy paper is used, the number of sheets of a sheet bundle cannot be increased. Further, when sheets having a small friction coefficient of the surface thereof such as glossy paper are used, if they are conveyed by being held under pressure by the folding roller pair, a slip occurs between the outside sheet in contact with the rollers and the inside sheet thereof and a problem arises that the outside sheet is conveyed prior. In this embodiment, when heavy paper, glossy paper, or OHP sheets are selected as a sheet, the folding process of one sheet is performed. When plain paper or thin paper is selected as a sheet, a plurality of sheets are buffered and folded.

Figure 7A:
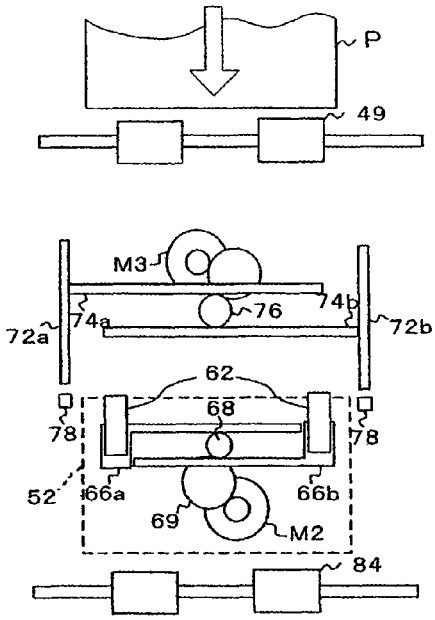
FIGS. 7A to 7D are schematic views for explaining the operation of the taking-in portion when processing sheets one by one.
Figure 7B:
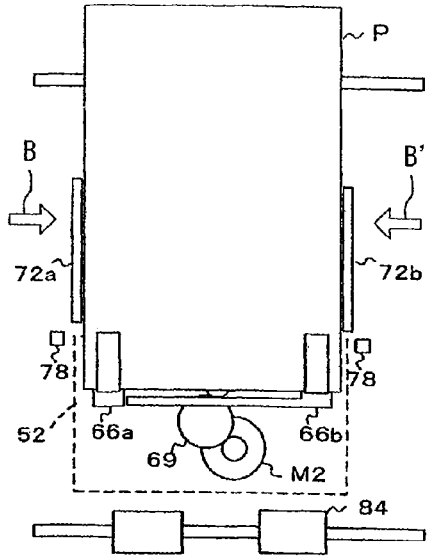

The operation of the taking-in portion 50 when processing sheets one by one will be explained by referring to FIGS. 7A to 7D. As shown in FIG. 7A, when the sheet P is conveyed, the stack portion 62 stands by in the state that it is closed in the sheet width direction. If the sheet leading edge sensor 64 detects that the lower end of the sheet P is received by the stack portion 62, the lateral alignment members 72*a* and 72*b* move in the directions of the arrows B and B' shown in FIG. 7B and strike both edges of the sheet to align the sheet in the width direction. In this state, the folding plate 82 and folding roller pair 83 perform the folding process for the sheet P and form a fold on the sheet P.

Figure 7C:
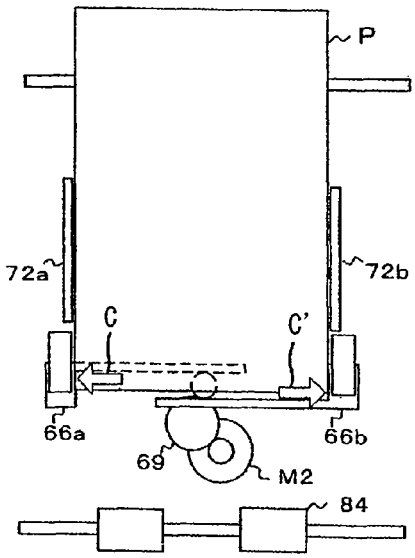
Figure 7D:
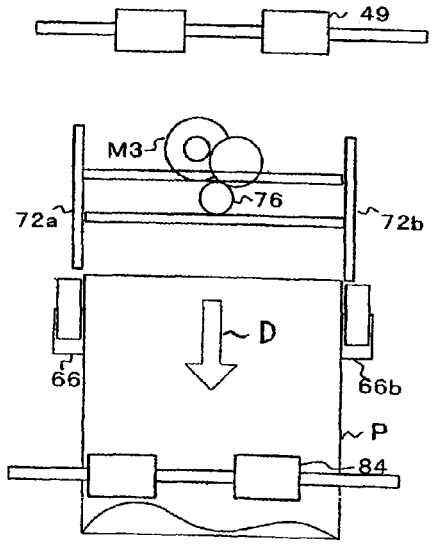

When the lateral alignment is performed for the sheet, in the directions of the arrows C and C' shown in FIG. 7C, the bridging members 66*a* and 66*b* move and open mutually in the opposite directions in the width direction of the sheet and the holding of the lower end of the sheet P by the stack portion 62 is released. The lateral alignment members 72*a* and 72*b* may open in the sheet width direction and stand by before the succeeding sheet is conveyed. At this stage, the lateral alignment members 72*a* and 72*b* may open in the sheet width direction. When the holding of the lower end of the sheet P is released, the sheet P falls by its own weight or moves in the direction of the arrow D by the second conveying rollers 84 and then is carried out to the alignment portion 88 via the third conveying roller 86 (FIG. 7D). The aforementioned operation is repeated for each sheet and the creased sheet is conveyed to the alignment portion. In the case of processing sheets one by one, the lateral alignment does not always need to be performed. By performing such a one-sheet process, the load on the folding portion 80 during the folding operation can be reduced and no slip occurs naturally between the sheets, so that even if heavy paper or glossy paper is used, the post process can be performed without trouble.

Next, the operation of the taking-in portion 50 when processing a plurality of sheets at one time will be explained by referring to FIGS. 8A to 8D. FIGS. 8A to 8D are all schematic views of the taking-in portion 50 viewed from the side of the taking-in portion 50. A first conveying guide 110 and a second conveying guide 111 guide sheets to the stack portion 62. A taking-in guide 112 supports sheets loaded on the stack portion 62 in a standing position. The taking-in guide 112 is opposite to the first conveying guide 110 installed on the side of the taking-in aid member 65 at a more interval than the second conveying guide 111 and is arranged partially opposite to the second conveying guide 111 at an interval. Even when processing a plurality of sheets at one time, the operations of the stack portion 62 and lateral alignment members 72*a* and 72*b* are basically similar to those explained in FIGS. 7A to 7D.

Figure 8A:
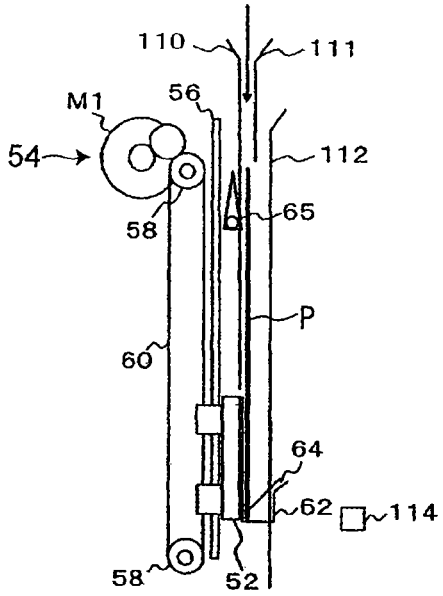
FIGS. 8A to 8D are schematic views for explaining the operation of the taking-in portion when processing a plurality of sheets at one time.
Figure 8B:
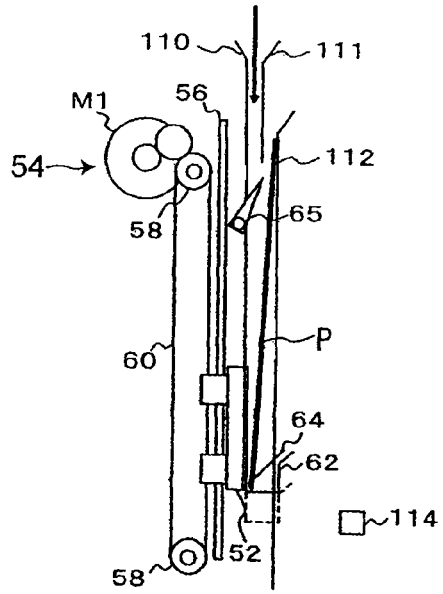
Figure 8C:
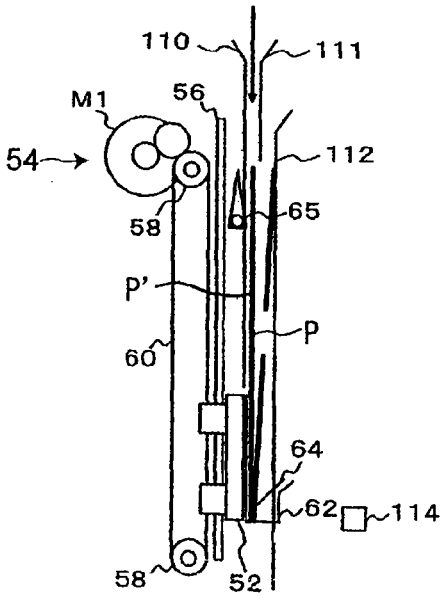
Figure 8D:
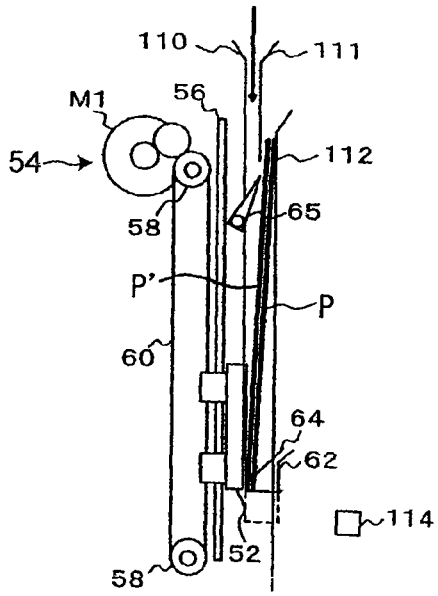

Firstly, if the sheet P is conveyed between the first and second conveying guides 110 and 111, the stack portion 62 stands by at the standby position (hereinafter, referred to as the home position or HP) in the state that it is closed in the sheet width direction and receives the lower end of the sheet P (FIG. 8A). If the sheet leading edge sensor 64 detects that the stack portion 62 receives the sheet P, the taking-in aid member 65 operating by a solenoid rotates and strikes the surface of the sheet P, thus the upper end of the sheet P moves toward the taking-in guide 112. If the sheet P moves toward the taking-in guide 112, the stack position 62 moves up until the upper end of the sheet P comes between the second conveying guide 111 and the taking-in guide 112 (FIG. 8B). In this state, the stack portion 62 receives a succeeding sheet P'. If the sheet leading edge sensor 64 detects that the stack portion 62 receives the sheet P', the stack portion 62 moves down to the position where the upper end of the sheet P' comes lower than the lower end of the second conveying guide 111, for example, the HP (FIG. 8C). If the stack portion 62 moves up to the HP, the taking-in aid member 65 rotates and strikes the surface of the sheet P' and moves the upper end of the sheet P' toward the taking-in guide 112, and the stack portion 62 moves up until the upper end of the sheet P' comes between the second conveying guide 111 and the taking-in guide 112 (FIG. 8D). Here, the HP of the stack portion 72, for example, may be detected by a position sensor 114 having a micro-sensor or a micro-actuator or may be subject to the pulse control using a stepping motor for the motor M1.

The aforementioned operation is repeated until a predetermined number of sheets, for example, two or three sheets are loaded on the stack portion 62 and at the stage that the predetermined number of sheets are loaded, the lateral alignment members 72*a* and 72*b* perform the lateral alignment. Then, the folding plate 82 and folding roller pair 83 perform the folding process for the sheet bundle and crease the sheet bundle. If the folding process is performed for the sheet bundle, the bridging members 66*a* and 66*b* open mutually in the opposite directions in the sheet width direction and the sheet bundle falls because the holding of the lower end is released or is conveyed by the second conveying rollers 84. Furthermore, the sheet bundle is carried out to the alignment portion 88 via the third conveying roller 86. As mentioned above, the taking-in portion 50 has a buffering mechanism and before the stitching process, can load, fold, and convey for each plurality of sheets.

In FIG. 8A, the HP where the stack portion 62 stands by may be a position where the position of the upper end of the sheet P conveyed comes below the lower end of the second conveying guide 111. The stack portion 62 located upper part from the HP receives the sheet P, the taking-in aid member 65 moves the sheet P toward the taking-in guide 112 after the stack portion 62 moved to the HP, then the sheet P may be moved upwards by the stack portion 62. The position where, as for the HP in which the stack portion 62 stands by, the stack portion 62 caught the sheet P may be the upper part from the HP. The HP in which the stack portion 62 stands by should be just low to sufficient grad for the upper edge of the sheet P making it move to between the second conveying guide 112 and the taking-in guide 112 by the taking-in aid member 65.

Figure 9:
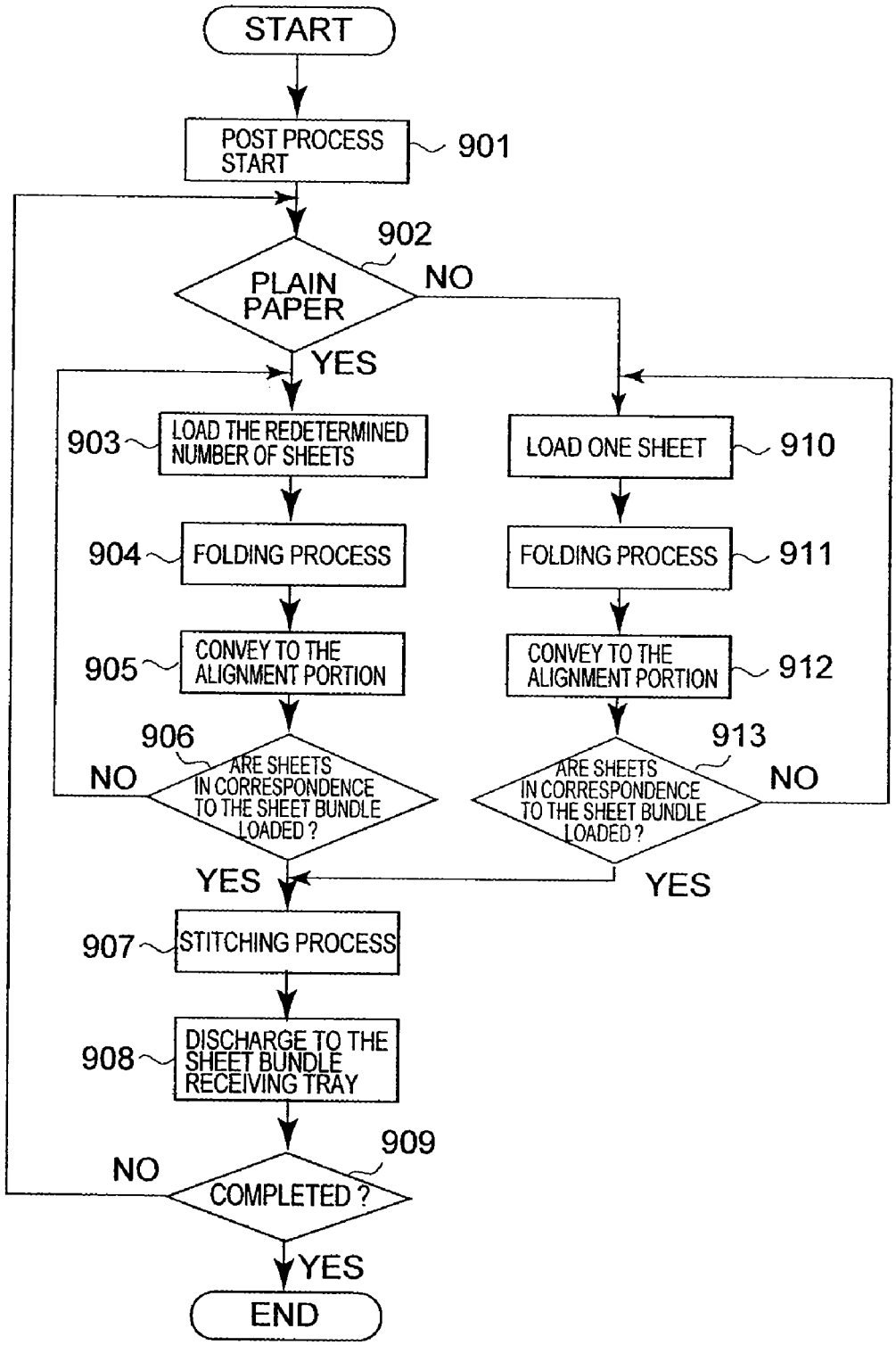
FIG. 9 is a flow chart for explaining the flow of the post processing operation for sheets.

Next, the flow of the sheet post-processing operation will be explained briefly by referring to FIG. 9.

At 901, the controller 140 of the sheet post-processing apparatus 4 obtains information such as an operation instruction and sheet kind and thickness from the operation panel 5 or PC 150 and starts the post process such as the folding process or saddle stitching process. The controller 140, at 902, judges the sheet kind carried in the sheet post-processing apparatus 4 form the image forming apparatus 1. When sheets are plain paper or thin paper (hereinafter, all referred to as first sheets, in the flow chart, referred to as plain paper), the taking-in portion 50, at 903, loads temporarily a predetermined number of sheets, for example, three sheets in a standing position. If the predetermined number of sheets are loaded on the taking-in portion 50, at 904, the folding portion 80 performs the folding process for the first sheets loaded on the taking-in portion 50. If the folding process is performed for the first sheets, at Step 905, the taking-in portion 50 releases the holding of the first sheets and the conveying member such as the second conveying rollers 84 or the third conveying roller 86 conveys the first sheets to the alignment portion 88. The controller 140, at 906, until the first sheets (in correspondence to the sheet bundle) of the number of job copies are conveyed to the alignment portion 88, repeats the aforementioned process.

At 906, if the first sheets in correspondence to the sheet bundle are loaded on the loading member 90 of the alignment portion 88, at 907, they are aligned laterally and the saddle stitch member 104 stitches the sheet bundle at the folding position. If the stitching process is performed, at 908, the exit rollers 120 discharge the sheet bundle to the sheet bundle receiving tray 122. The controller 140, at 909, until the post process is performed for the sheet bundle in correspondence to the number of job copies, repeats the aforementioned process. Further, when performing repeatedly the process at 909, at 902, the controller 104 does not always need to judge again the sheet kind.

On the other hand, at 902, when sheets are thicker than the first sheets such as heavy paper or glossy paper or sheets are ones having a smaller friction coefficient of the surface than the friction coefficient of the surface of the first sheets (hereinafter, all referred to as second sheets), at 910, the taking-in portion 50 loads temporarily one second sheet in a standing position. Whenever one of the second sheets is loaded on the taking-in portion 50, the folding portion 80, at 911, performs the folding process for the second sheets. Whenever the folding process is performed for the second sheets, at 912, the taking-in portion 50 releases the holding of the second sheets and the conveying member such as the second conveying rollers 84 or the third conveying roller 86 conveys the second sheets to the alignment portion 88. The controller 140, at 913, until the second sheets (in correspondence to the sheet bundle) of the number of job copies are conveyed to the alignment portion 88, repeats the aforementioned process and executes 907 to 909.

Further, at 907, while the alignment portion 88 performs the lateral aligning process and the saddle stitch member 104 performs the stitching process, the taking-in portion 50 performs the folding process.

The sheet post-processing apparatus 4 of the first embodiment aforementioned includes the taking-in portion 50 for supporting sheets in a standing position and the alignment portion 88 for loading sheets carried out at a slight slope to the horizontal direction on the downstream side in the conveying direction on each side. Before performing the stitching process by the alignment portion 88, in addition to execution of the folding process, the one-sheet folding process and plural-sheets folding process are performed selectively depending on the sheet kind, thus a sheet bundle composed of more sheets than the conventional apparatus for folding sheets in two can be post-processed. Further, even if heavy paper or glossy paper is used, the post process can be performed without trouble.

Further, the folding process and the succeeding stitching process are performed at different positions in the conveying direction. Therefore, at the same time that the alignment portion 88 and saddle stitch member 104 perform the lateral alignment process and stitching process, the taking-in portion 50 can perform the folding process and the throughput of processing sheets is good. Further, when plain paper is used, the taking-in portion 50 performs buffering, thus in the sheet post-processing apparatus 4, the sheet conveying speed can be increased and the throughput becomes better.

Further, in the aforementioned apparatus, the alignment portion 88 loads sheets, and in the folding portion 80, the load at time of execution of the folding process is small, and a strong structure is not necessary, so that the apparatus can be miniaturized.

Figure 10:
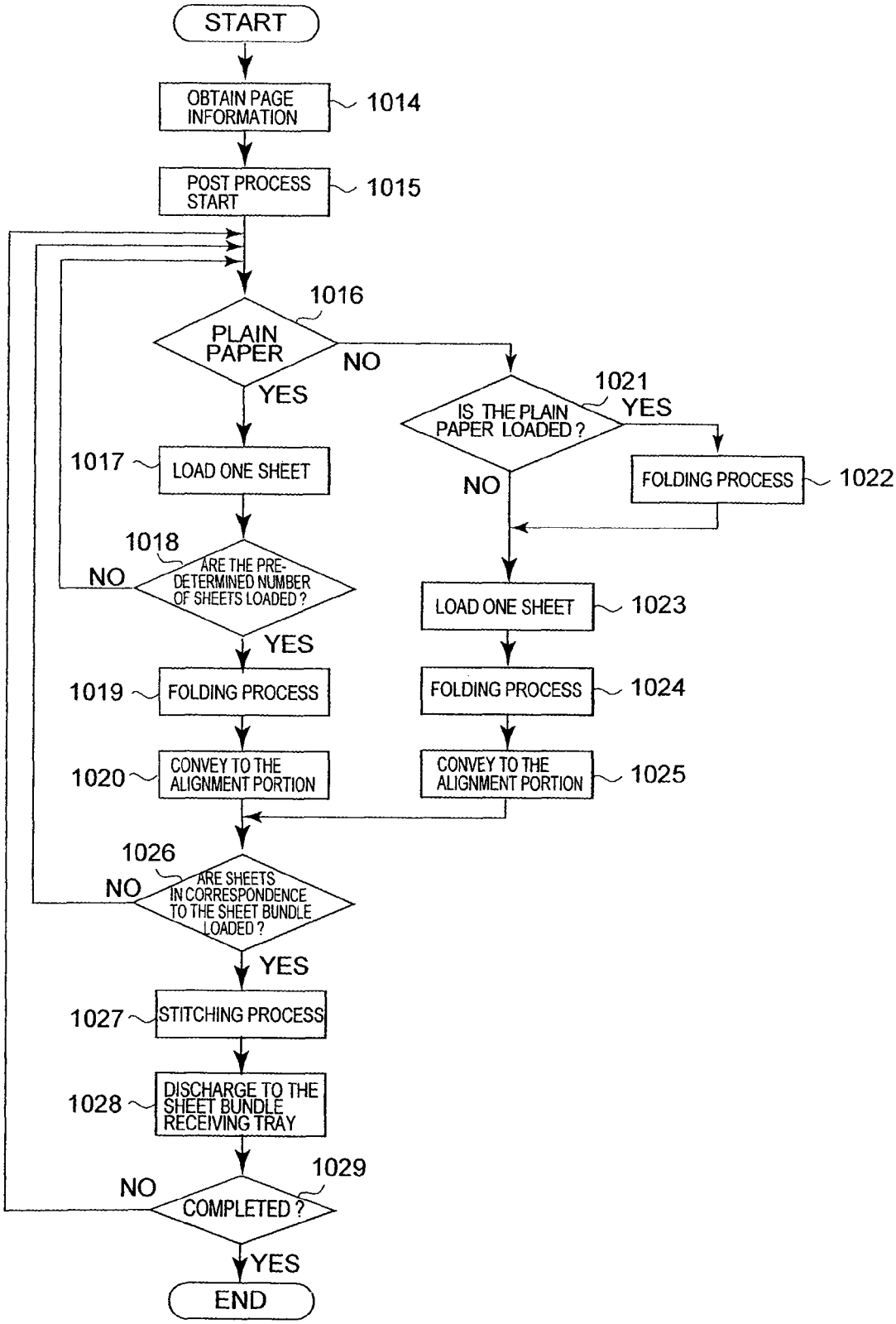
FIG. 10 is a flow chart for explaining the flow of the post processing operation for sheets relating to a modification of the first embodiment.

(Modification of the first embodiment) In this embodiment, the processing operation when a sheet bundle to be post-processed is composed of a mixture of plain paper and another paper such as heavy paper or glossy paper will be explained. Further, in the respective units of this embodiment, to the same parts as those of the sheet folding apparatus of the aforementioned embodiment, the same numerals are assigned and the characteristic parts of this embodiment will be explained by referring to FIG. 10.

The controller 140 of the sheet post-processing apparatus 4, at 1014, obtains information such as an operation instruction and sheet kind and thickness from the operation panel 5 or PC 150 and obtains information for each page. The controller 140, upon receipt of the information, at 1015, starts the post process such as the folding process or saddle stitching process.

The controller 140, from the page information obtained, at Step 1016, judges the thickness and kind of sheets to be conveyed to the taking-in portion 50 for each page. When the sheets are the first sheets, at 1017, the taking-in portion 50 loads one sheet in a standing position. At 1018, when a predetermined number of sheets, for example, three first sheets are loaded on the taking-in portion 50, at 1019, the folding portion 80 performs the folding process for the first sheets loaded on the taking-in portion 50. After the folding process, at 1020, the taking-in portion 50 releases the holding of the first sheets and the conveying member such as the second conveying rollers 84 or the third conveying roller 86 conveys the first sheets to the alignment portion 88.

On the other hand, at 1018, when the predetermined number of first sheets are not loaded, the controller 140 returns to 1016 and judges whether the sheets to be loaded next on the taking-in portion 50 are the first sheets or the second sheets. Here, when the sheets are the second sheets, at 1021, the controller 140 judges existence of the first sheets loaded already on the taking-in portion 50. When there are no first sheets loaded, at 1023, the controller 140 conveys the second sheets to the taking-in portion 50. On the other hand, when there are the first sheets loaded, before conveying the second sheets to the taking-in portion 50, at 1022, the folding portion 80 performs the folding process. After the creased first sheets are conveyed from the taking-in portion 50, at 1023, the controller 140 conveys the succeeding second sheets to the taking-in portion 50.

Then, whenever one of the second sheets is loaded on the taking-in portion 50, at 1024, the folding portion 80 performs the folding process for the second sheets. After the folding process, at 1025, the taking-in portion 50 releases the holding of the second sheets and the conveying member such as the second conveying rollers 84 or the third conveying roller 86 conveys the second sheets to the alignment portion 88.

Until sheets in correspondence to a sheet bundle are loaded on the loading member 90 of the alignment portion 88, at 1026, the controller 140 repeats the aforementioned operation. When the sheets in correspondence to a sheet bundle are loaded, at 1027, the lateral alignment is performed and the saddle stitch member 104 stitches the sheet bundle at the folding position. If the stitching process is performed, at 1028, the exit rollers 120 discharge the sheet bundle to the sheet bundle receiving tray 122. Further, the controller 140, at 1029 repeats the aforementioned process until the post process is performed for the sheets of the number of job copies.

According to the sheet post-processing apparatus 4 of a modification of the first embodiment, even if a sheet bundle to be post-processed is a mixture with plain paper and the paper of other kinds containing heavy paper or glossy paper, the similar effects to those of the first embodiment can be obtained.

Further, the judgment of the page information executed by the controller 140 is not limited to the execution at 1016 and it is possible to at the point of time when it is received at 1015, store beforehand judgment results corresponding to each page in the memory and at 1016, read the judgment results from the memory.

Figure 11:
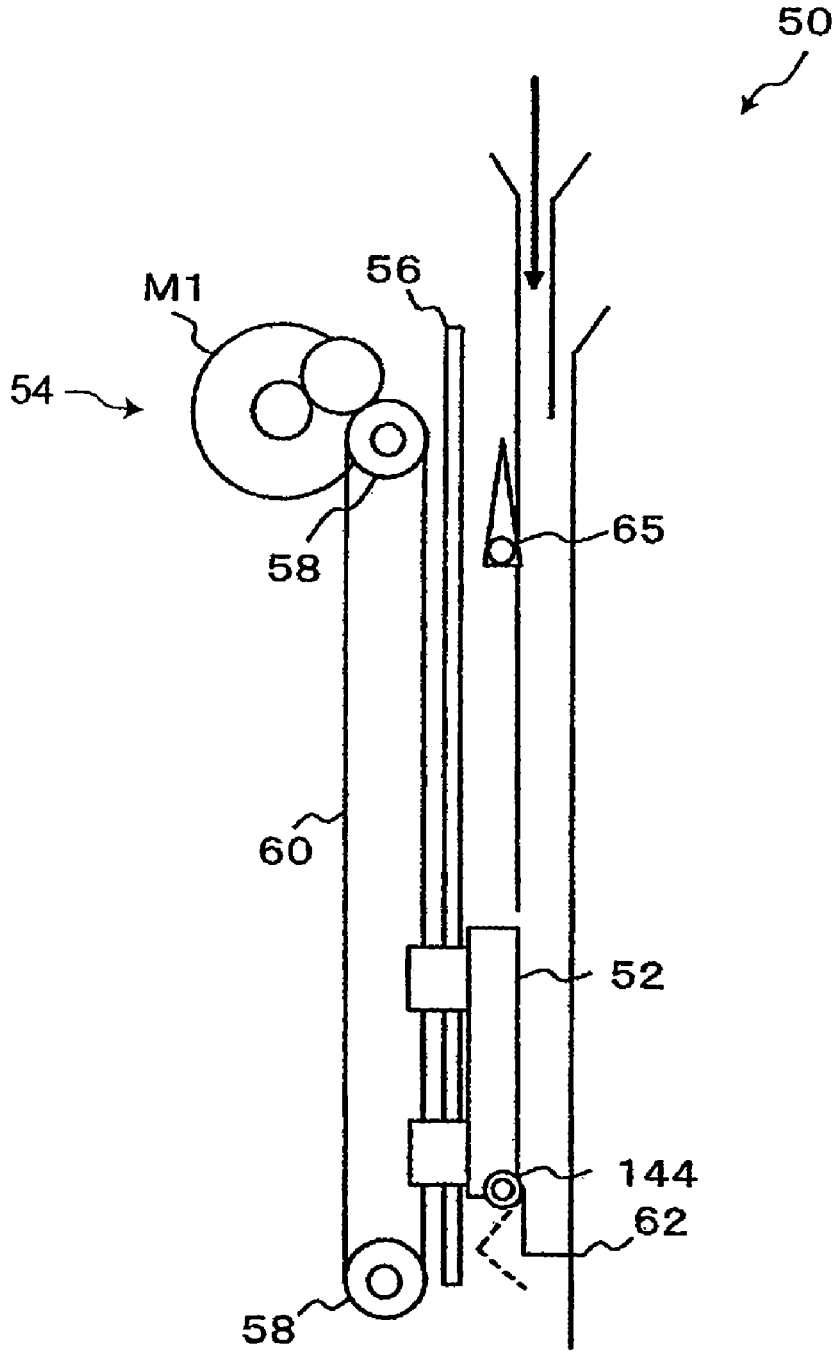
FIG. 11 is a schematic view for explaining the taking-in portion of a modification of the first embodiment.

Further, in the aforementioned embodiment, the stack portion 62 opening and closing in the sheet width direction is described, though the present invention is not limited to it. Namely, the stack portion 62 may support temporarily sheets and then release the support and for example, as shown in FIG. 11, the stack portion 62 may be rotate at a fulcrum of the rotary shaft 144. Further, in this case, the stack portion 62 may make it rotate by solenoid, a stepping motor, etc.

Although the invention is shown and described with respect to certain illustrated aspects, it will be appreciated that equivalent alterations and modifications will occur to others skilled in the art upon the reading and understanding of this specification and the annexed drawings. In particular regard to the various functions performed by the above described components, the terms used to describe such components are intended to correspond, unless otherwise indicated, to any component which performs the specified function of the described component (e.g., that is functionally equivalent), even though not structurally equivalent to the disclosed structure, which performs the function in the herein illustrated exemplary aspects of the invention.

What is claimed is:

1. A sheet post-processing apparatus comprising:

a taking-in portion configured to support sheets conveyed with leading edges of the sheets in a conveying direction directed downward in a standing position and release the support of the sheets;

a folding portion configured to crease the sheets, which are supported by the taking-in portion, by pressing and releasing the creased sheets into the taking-in portion;

a loading portion arranged under the taking-in portion to load the creased sheets conveyed from the taking-in portion;

a stitching portion configured to stitch a sheet bundle loaded on the loading portion; and a controller configured to execute conveying of the sheets to the taking-in portion and creasing of the sheets supported on the taking-in portion by the folding portion during stitching of the creased sheet bundle loaded on the loading portion by the stitching portion, the controller switches switching between a first processing mode of supporting a plurality of sheets on the taking-in portion and then creasing simultaneously the plurality of sheets by the folding portion, and a second processing mode of creasing the sheet by the folding portion according to a kind of sheet conveyed, whenever one of the sheets is supported by the taking-in portion.

2. The apparatus according to claim 1, further comprising the controller executing the first processing mode when the sheets conveyed are first sheets, and executing the second processing mode when the sheets conveyed are second sheets thicker than the first sheets or having a smaller surface friction coefficient than a surface friction coefficient of the first sheets.

3. The apparatus according to claim 2, further comprising the controller, when conveying the second sheets to the taking-in portion before the plurality of first sheets are supported by the taking-in portion, creasing the first sheets loaded by the taking-in portion by the folding portion, carrying out the first sheets from the taking-in portion, and then conveying the second sheets to the taking-in portion.

4. The apparatus according to claim 2 further comprising:

an alignment portion configured to align the sheet bundle before stitching the sheet bundle loaded on the loading portion by the stitching portion.

5. The apparatus according to claim 1 further comprising:

a first conveying guide configured to guide the sheets conveyed to the taking-in portion; and a second conveying guide provided opposite to the first conveying guide, the taking-in portion including a taking-in guide configured to support the sheets guided by the first conveying guide and the second conveying guide in a standing position.

6. The apparatus according to claim 5 further comprising:

a taking-in aid member configured to move the sheets guided by the first conveying guide and the second conveying guide toward the taking-in guide.

7. A sheet post-processinq apparatus comprising:

taking-in means for supporting sheets conveyed with leading edges of the sheets in a conveying direction directed downward in a standing position and releasing the support of the sheets;

folding means for creasing the sheets supported by the taking-in means and releasing again the creased sheets into the taking-in means;

loading means arranged under the taking-in means for loading the creased sheets conveyed from the taking-in means;

stitching means for stitchinq a sheet bundle loaded on the loading means; and control means for executing conveyance of the sheets to the taking-in means and creasing of the sheets supported by the taking-in means by the folding means during stitching of the creased sheet bundle loaded on the loading means by the stitching means, the control means switching between a first processing mode of supporting a plurality of sheets on the taking-in means and then creasing simultaneously plurality of sheets by the folding means, and a second processing mode of creasing the sheet by the folding means according to a kind of the sheet conveyed, the second processing mode being used whenever one of the sheets is supported by the taking-in means.

8. The apparatus according to claim 7, further comprising the control means executing the first processing mode when the sheets conveyed are first sheets, and executing the second processing mode when the sheets conveyed are second sheets thicker than the first sheets or having a smaller surface friction coefficient than a surface friction coefficient of the first sheets.

9. The apparatus according to claim 8, further comprising the control means, when conveying the second sheets to the taking-in means before the plurality of first sheets are supported by the taking-in means, creasing the first sheets loaded by the taking-in means by the folding means, carrying out the first sheets from the taking-in means, and then conveys conveying the second sheets to the taking-in means.

10. The apparatus according to claim 7 further comprising:

an alignment means for aligning the sheet bundle before stitching the sheet bundle loaded on the loading means by the stitching means.

11. The apparatus according to claim 7 further comprising:

a first conveying guide means for guiding the sheets conveyed to the taking-in means; and a second conveying guide means provided opposite to the first conveying guide means, the taking-in means including taking-in guide means for supporting the sheets guided by the first conveying guide means and the second conveying guide means in a standing position.

12. The apparatus according to claim 11 further comprising:

taking-in aid means for moving the sheets guided by the first conveying guide means and the second conveying guide means toward the taking-in guide means.

13. A sheet post-processing method comprising:

supporting sheets conveyed with leading edges of the sheets in a conveying direction directed downward in a standing position by a taking-in portion;

creasing the sheets supported in the standing position by the taking-in portion by a folding portion and then releasing again the sheets into the taking-in portion;

conveying the creased sheets in the taking-in portion to a loading portion arranged under the taking-in portion;

loading the creased sheets conveyed on the loading portion;

stitching a creased sheet bundle loaded on the loading portion by a stitching portion; and executing conveyance of the sheets to the taking-in portion and creasing of the sheets supported by the taking-in portion by the folding portion during stitching of the sheet bundle by the stitching portion; and switching between a first processing mode of supporting a plurality of first sheets on the taking-in portion and then creasing simultaneously the plurality of first sheets by the folding portion, and a second processing mode of creasing the one of the sheets by the folding portion according to a kind of the sheets conveyed, whenever one of the sheets is supported by the taking-in portion.

14. The method according to claim 13 further comprising: supporting a plurality of the first sheets on the taking-in portion and then creasing simultaneously the plurality of the first sheets by the folding portion when the sheets conveyed are first sheets, and creasing the sheet by the folding portion when the sheets conveyed are second sheets thicker than the first sheets or having a smaller surface friction coefficient than a surface friction coefficient of the first sheets, whenever one of the sheets is supported by the taking-in portion.

15. The method according to claim 14, wherein further comprising, when conveying the second sheets to the taking-in portion before the plurality of first sheets are supported by the taking-in portion, the first sheets loaded by the taking-in portion being creased by the folding portion and carried out from the taking-in portion and then the second sheets being conveyed to the taking-in portion.

16. The method according to claim 13 further comprising: aligning the sheet bundle before stitching the sheet bundle loaded on the loading portion by the stitching portion.

17. The method according to claim 13 further comprising: guiding the sheets conveyed to the taking-in portion by a first conveying guide and a second conveying guide provided opposite to the first conveying guide.

* * * * *